United States Patent [19]

Frishman

[11] 4,255,001

[45] Mar. 10, 1981

[54] DISPLAY CASE

[75] Inventor: Daniel Frishman, Andover, Mass.

[73] Assignee: Akko, Inc., Lawrence, Mass.

[21] Appl. No.: 969,419

[22] Filed: Dec. 14, 1978

[51] Int. Cl.[3] ..... A47G 19/08; A47F 3/00; B65D 5/50

[52] U.S. Cl. ..... 312/114; 312/245; 312/284; 206/45.19; 211/41; 248/441 A

[58] Field of Search ..... 312/114, 245, 206, 207, 312/204, 128, 284; 206/45.14, 45.19, 45.34; 248/441 A, 459, 450; 211/41; D6/142

[56] References Cited

U.S. PATENT DOCUMENTS

| | | | |
|---|---|---|---|
| D. 234,172 | 1/1975 | Ranney | D6/142 |
| 895,211 | 8/1908 | Twitchell | 211/41 |
| 1,194,801 | 8/1916 | Williamson | 248/450 |
| 1,313,018 | 8/1919 | Rushton | 211/41 |
| 1,361,630 | 12/1920 | Singer et al. | 248/459 |
| 1,453,437 | 5/1923 | Burnham | 211/41 |
| 2,010,734 | 8/1935 | Parker | 211/41 |
| 2,222,665 | 11/1940 | Hoenigsberg | 248/459 |
| 2,331,792 | 10/1943 | Noel | 211/41 |
| 2,477,274 | 7/1949 | Trecek | 206/45.19 |
| 2,498,757 | 2/1950 | High | 206/45.19 |
| 2,747,732 | 5/1956 | Fischer | 206/45.19 |
| 2,927,687 | 3/1960 | Sanford | 206/45.19 |
| 2,937,910 | 5/1960 | Randa | 312/207 |
| 3,045,812 | 7/1962 | Randolph | 206/45.19 |
| 3,406,816 | 10/1968 | Green et al. | 206/45.34 |
| 3,517,801 | 6/1970 | Cote | 206/45.14 |
| 3,746,156 | 7/1973 | Austin, Jr. et al. | 206/45.19 |
| 3,904,029 | 9/1975 | Koltz | 206/45.34 |

*Primary Examiner*—Victor N. Sakran
*Attorney, Agent, or Firm*—Wolf, Greenfield & Sacks

[57] ABSTRACT

A plate showcase device for supporting a plate or the like in a display position having a protective cover with a lid over a base portion. The plate is supported within the cover and on the base portion in an almost vertical position by a stud projecting from the rear wall of the protective cover and a slot located in the upper surface of the base portion. In a second preferred embodiment, a plate showcase device has an integral cover and base portion made of a single sheet of material providing a relatively flat showcase capable of being wall hung or self supporting.

1 Claim, 4 Drawing Figures

DISPLAY CASE

BACKGROUND OF THE INVENTION

The display of valuable china plates in homes, in museums and elsewhere presents unusual problems not present with other types of art. Normally, such items as paintings and sculptures are easily displayed in that paintings have a supporting frame while sculptures are self-supporting. On the other hand, valuable china, plaques and the like require a showcase which will provide support and protection, yet not affect the aesthetic features of the unit. There is a substantial demand for improved means for displaying china plates as works of art. It is estimated there are two million plate collectors in the United States. Heretofore these plate collectors have used simple stands, clips or picture frame type wall supports. These plate supports all have limitations. For example, simple stands do not provide a safe means of support, and are frequently expensive. Clips are aesthetically unacceptable and provide no substantial protection. Picture frames are difficult to match with the plates and are also usually expensive.

In the field of merchandise displays there is also a growing need to display merchandise in an attractive manner so that the merchandise can essentially sell itself. Such is the case in large department stores where large quantities of goods are displayed and sold with minimal sales personnel. The plateware section of a typical department store has many shelves of plates which are quite often damaged by the constant handling of the customers. Many stores attach their plates to self-standing frame devices so that the plate can be attractively viewed by a customer passing through the area. All too often the self-standing frame devices are so unattractive that they negatively affect the beauty of the plateware.

There is thus a need in the field of plate display, whether it be for artistic or commercial reasons, for a display showcase which supports, protects and attractively displays plateware.

BRIEF DESCRIPTION OF THE INVENTION

The present invention is a plate showcase device comprising means for supporting a plate in a display position; means for protecting a plate from structural damage and means for displaying a plate in either a wall hanging or a table display position.

In a preferred embodiment of the present invention a base portion provides a lower support for the plate. A protective cover extending upwardly from the base has a removable lid. A plate positioned within the cover is supported almost vertically by a stud projecting forwardly from the rear wall of the cover and by a slot or similar means in the base portion.

In order to provide display flexibility, the plate showcase device can be positioned to rest upon a table or be mounted on a wall. The cover is designed with an internal support bar positioned to hold the plate at an angle that minimizes the possibility of accidentally tipping over the plate showcase, notwithstanding the base depth-to-height ratio of the unit. Further, the wall from which the support bar projects has an opening for wall mounting means.

A second preferred embodiment of the present invention is made of a single sheet of a material such as acrylic and shaped to form an integral base portion, front and rear protective wall portion, as well as a top portion. The base portion has means for supporting the plate in the display. A support bar for retaining a plate in a nearly upright position and an orifice for wall hanging purposes are formed in the rear wall portion.

Both preferred embodiments may be made of a clear acrylic plastic or other such material that would meet the necessary support and display characteristics of the device.

DETAILED DESCRIPTION OF THE INVENTION

Figure 1:
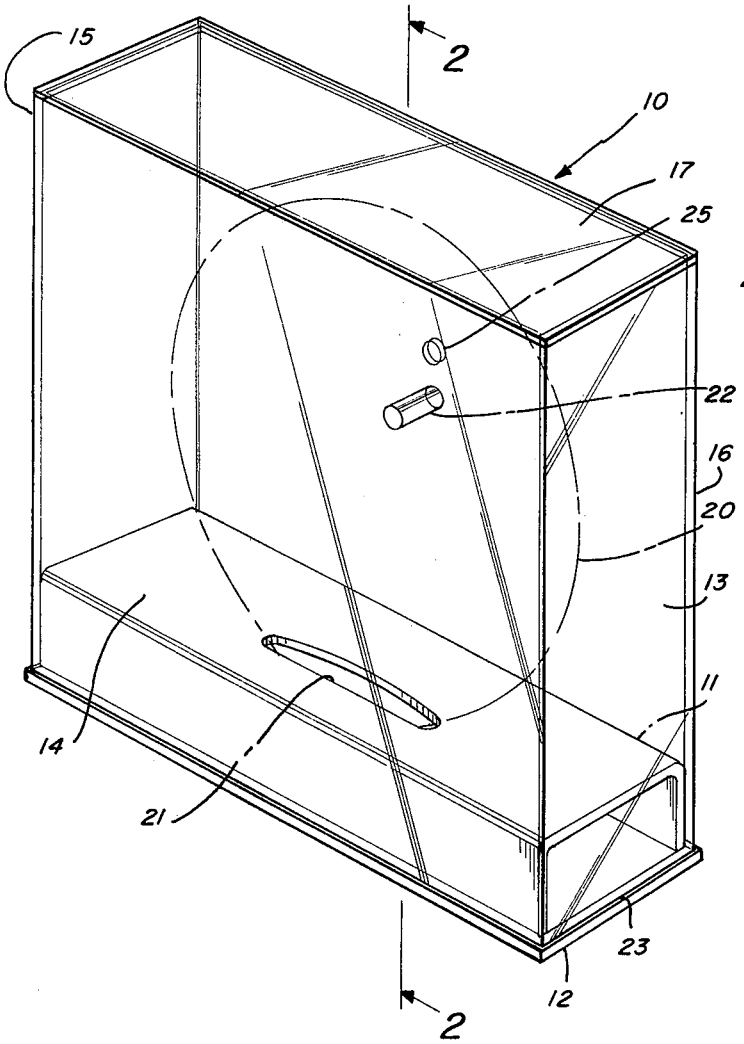
FIG. 1 is a perspective view of a preferred embodiment of a plate showcase device with a plate shown in phantom.
Figure 2:
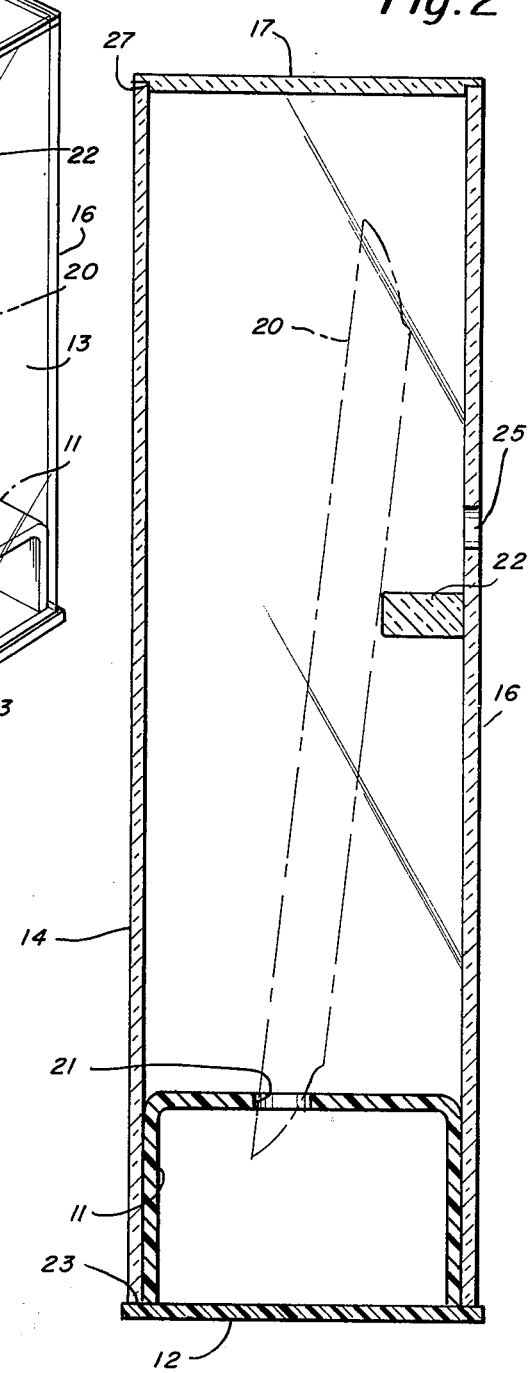
FIG. 2 is a section view of a preferred embodiment taken along lines 2—2 showing a plate in phantom view.

FIG. 1 illustrates a preferred form of the plate showcase device 10. In this embodiment the showcase is formed with a base portion 11, bottom plate 12 and a protective cover formed with sidewalls 13 through 16 inclusive, with a top or lid 17. The protective cover with the lid forms an enclosure within which a plate 20 is supported and displayed. The base portion 11 is preferably formed of an inverted U-shaped member having continuous upper wall and depending forward and rear walls. These depending forward and rear walls are supported on the bottom plate 12. A slot 21 is located in the upper wall of the base portion 11 and is preferably formed with an elongated shape equally distant from the ends of the base portion 11 and closer to the forward wall 14 than the rear wall 16. This slot 21 is designed to engage an edge of the plate 20 as illustrated in FIG. 2. It is clear that the longer the slot the greater portion of the plate will be concealed within the base portion 11. Therefore, the selection of the dimensions for the slot 21 depends in large measure upon the size of the plate which is to be displayed. Ideally, slot 21 should be less than one-third the length of the base portion 11.

The protective cover formed of a continuous piece of transparent plastic material, preferably acrylic, is essentially cylindrical in shape with the lower portions of the walls 14 and 16 abutting the depending walls of the base portion 11. For aesthetic purposes, the base portion 11 can be formed of a contrasting color, preferably black but possibly other colors, so that the base portion 11 will be viewed through the walls 14 and 16.

Preferably the bottom plate 12 extends beyond the depending walls of the base portion 11 and engages the bottom edges of the protective cover walls 13 through 16 inclusive. The bottom edges of the walls 13 through 16 inclusive may be suitably cemented to the base or bottom plate 12 which in turn is suitably secured to the base portion 11.

The lid or cover 17 should fit closely over the upper edges of the walls 13 and 16 with the periphery of the cover 17 formed with suitable offset 27 to properly engage and seat the lid over the walls 13 through 16, inclusive.

A projecting stud 22 is cemented to and projects forwardly from the forward surface of wall 16. Stud 22 is located symmetrically with respect to the sidewalls 13 and 15. The stud 22 is located slightly higher than halfway between the upper surface of the base portion 11 and the lid 17; it is about 60% of the distance from the bottom to the lid. The stud 22 projects forwardly a sufficient distance to support a plate at an angle of approximately 75° to 85°. In most instances, this means the stud 22 will have its forward end projecting forwardly from the wall 16 a distance approximately one-third to one-half of the distance from the wall 16 to the forward edge of slot 21.

While the dimensions of the showcase device may vary greatly depending upon the particular plates which are to be displayed, it is preferable to provide a display in which the depth of the display is small compared to the height of the display. This requirement results in a display case which has a flat and aesthetically pleasing appearance. It is for that reason that it is important to support the plate 20 in a substantially vertical plane. If the plate 20 were not supported in a substantially vertical plane, i.e., at an angle of about 75° to 85°, there would be a greater tendency for the display to inadvertently tip. This would occur if the plate 20 were inclined rearwardly a greater amount and consequently the center of balance of the unit moved closer to the rear wall 16.

Thus, in the embodiment illustrated in FIG. 1, the plate 20 is supported at an angle of almost 90°, preferably in the range of 75° to 85° in a display system in which the depth of the base is less than one-third of the height of the unit. It will also be noticed in the embodiment illustrated in FIGS. 1 and 2, and particularly as illustrated in FIG. 2, that the particular arrangement of the stud 22 and forward edge of slot 21 positions the plate 20 approximately equidistant from the rear wall 16 and forward wall 14. This arrangement is achieved by making sure the forward edge of slot 21 is closer to wall 14 than wall 16 and the forward edge of stud 22 is closer to wall 16 than wall 14. Further, an aperture 25 may be formed, preferably above stud 22, so that the display may be secured to a wall.

In the embodiments illustrated in FIGS. 1 and 2, alternate means may be provided for supporting the lower portion of the plate. In place of the slot 21, two vertical posts on the base can be employed. Alternately, a pair of clear horizontal posts secured to the rear wall 16 may be provided. These posts would be formed with aligned horizontal grooves designed to engage the lower edges of the plate when the plate rested on the posts.

Figure 3:
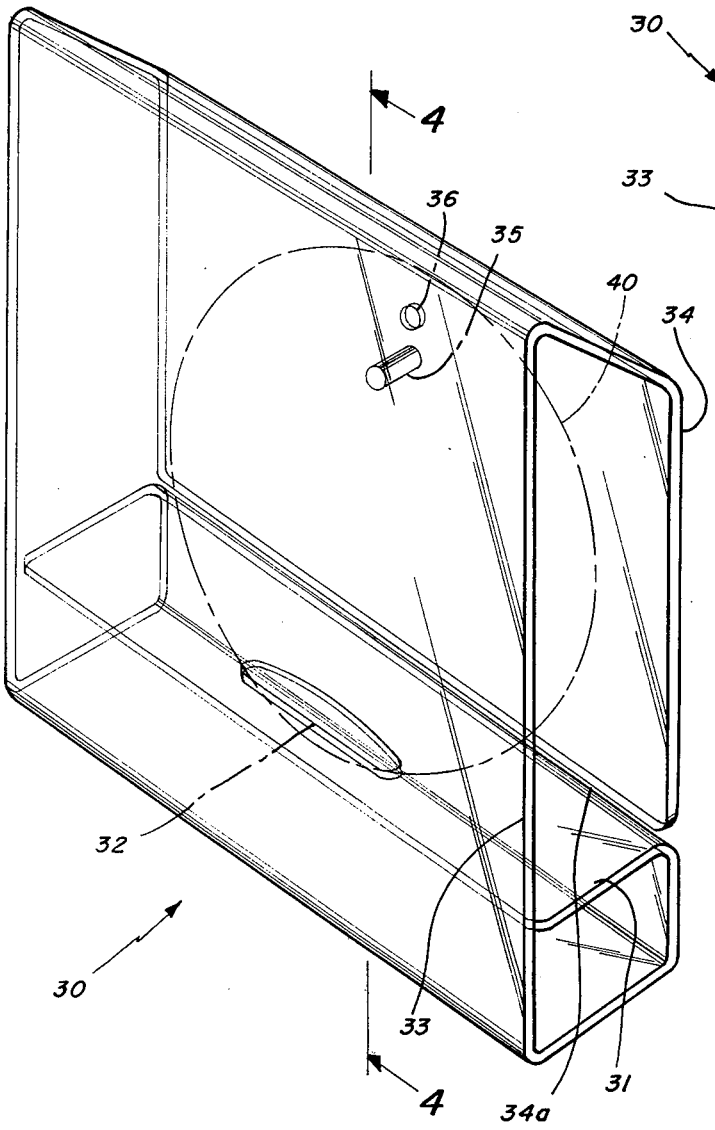
FIG. 3 is a perspective view of another preferred embodiment of a plate showcase device with a plate shown in phantom.
Figure 4:
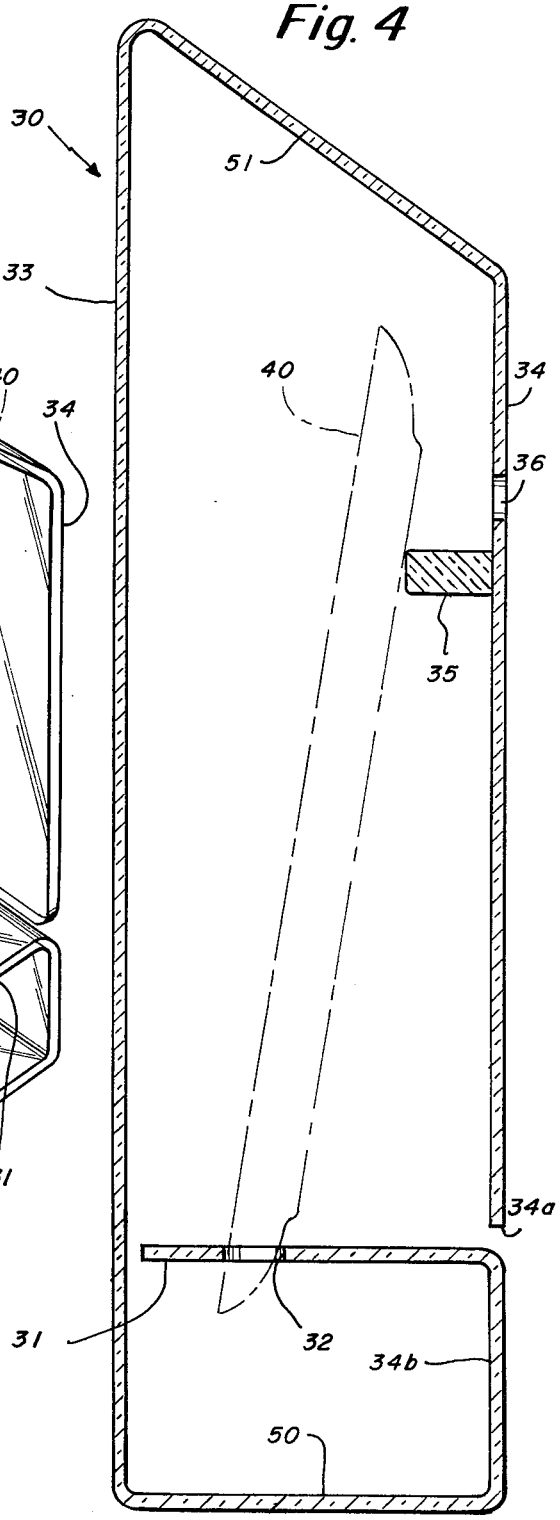
FIG. 4 is a section view of the preferred embodiment FIG. 3 along lines 4—4 with a plate shown in phantom view.

The embodiments illustrated in FIGS. 3 and 4 include an arrangement made of a single piece of transparent plastic material. In this arrangement, the base portion designed to support the bottom of the plate is formed of one end of the continuous piece of plastic. This piece of plastic is bent to shape the upper surface 31 of the base portion which is formed with a slot 32. Upper surface 31 is continuous with a rear wall 34B, in turn continuous with a bottom wall 50 and the lower end of a forward wall 33. Forward wall 33 forms both the forward wall of the base portion and the front wall of the display 30.

The top of the display is formed with a wall 51 continuous with wall 33 and preferably angled at a reentrant angle downwardly to a juncture with the upper edge of rear wall 34. The slot 32 is located closer to wall 33 than wall 34 while the stud 35 projects forwardly from wall 34 to a point more remote from wall 33 than wall 34. The relative dimensions and locations of the stud 34 and slot 32 are similar to that as illustrated in the preferred embodiment. The lower edge of wall 34 may terminate just above the upper surface 31.

An aperture 36 may be formed preferably above stud 35 so that the display may be secured to a wall. The dimensions of the device illustrated in FIGS. 3 and 4 are preferably comparable to those as described in connection with the embodiments of FIGS. 1 and 2.

Having now described my invention, I claim:

1. A plate showcase formed of a continuous integral length of transparent plastic having a single width, with one end of said plastic folded to form an elongated base having an upper surface with plate retaining means formed therein, said retaining means comprising a slot adapted to prevent lateral movement of said plate within the showcase, and with the other end of said sheet of plastic shaped to form a protective cover with means integral therewith supporting said plate at an angle of substantially 75° to 85° said support means projecting generally horizontally from and fixed to said protective cover.

* * * * *